US006820757B2

(12) United States Patent
Craft et al.

(10) Patent No.: US 6,820,757 B2
(45) Date of Patent: Nov. 23, 2004

(54) BEAM STRUCTURES FOR SHELVING APPARATUS

(75) Inventors: Charles William Craft, Apple Creek, OH (US); David Michael Stitchick, Wooster, OH (US)

(73) Assignee: Rubbermaid Incorporated, Wooster, OH (US)

( * ) Notice: Subject to any disclaimer, the term of this patent is extended or adjusted under 35 U.S.C. 154(b) by 0 days.

(21) Appl. No.: 10/017,853

(22) Filed: Dec. 14, 2001

(65) Prior Publication Data

US 2002/0092818 A1 Jul. 18, 2002

Related U.S. Application Data

(60) Provisional application No. 60/261,329, filed on Jan. 12, 2001.

(51) Int. Cl.[7] ..... A47F 5/00

(52) U.S. Cl. ..... 211/188; 211/133.1

(58) Field of Search ..... 211/188, 186, 211/194, 133.1

(56) References Cited

U.S. PATENT DOCUMENTS

| | | | | |
|---|---|---|---|---|
| 3,053,558 | A | 9/1962 | Challas, Jr. et al. | 287/119 |
| 3,669,033 | A | 6/1972 | Murcia | 108/111 |
| 3,734,032 | A | 5/1973 | Kovacik | 108/111 |
| 3,788,242 | A | 1/1974 | Hassel et al. | 108/111 |
| D245,744 | S | 9/1977 | Brooks | D6/186 |
| 4,099,472 | A | 7/1978 | Kellogg | 108/114 |
| D249,618 | S | 9/1978 | Oxenhandler | D6/186 |
| 4,145,977 | A | 3/1979 | Yellin | 108/111 |
| 4,467,927 | A | 8/1984 | Nathan | 211/153 |
| 4,574,709 | A | 3/1986 | Lackey et al. | 108/111 |
| 4,593,825 | A | 6/1986 | Hepp | 211/126 |
| 4,615,278 | A | 10/1986 | Cabrelli | 108/111 |
| 4,621,740 | A | 11/1986 | Lang | 211/133 |
| 4,706,576 | A | 11/1987 | James | 108/111 |
| 4,843,975 | A | 7/1989 | Welsch et al. | 108/24 |
| 4,852,501 | A | 8/1989 | Olson et al. | 108/111 |
| 4,940,150 | A | 7/1990 | Spengler | 211/188 |
| 4,953,719 | A | 9/1990 | Spamer | 211/188 |
| 4,989,519 | A | 2/1991 | Welsch et al. | 108/111 |
| 4,998,023 | A | 3/1991 | Kitts | 280/47.35 |
| 5,158,187 | A | 10/1992 | Taub | 211/186 |
| D330,652 | S | 11/1992 | Goetz | D6/479 |
| D330,819 | S | 11/1992 | Dickinson | D6/479 |
| D344,382 | S | 2/1994 | Conaway et al. | D34/21 |
| 5,303,645 | A | 4/1994 | Meacham | 100/144 |
| D347,131 | S | 5/1994 | Wolff | D6/479 |
| D362,138 | S | 9/1995 | Sagol | D6/479 |
| 5,588,541 | A | 12/1996 | Goetz | 211/188 |
| D384,226 | S | 9/1997 | Goetz | D6/479 |
| D385,132 | S | 10/1997 | Sagol | D6/479 |
| 5,683,004 | A | 11/1997 | Aho | 211/187 |
| 5,709,158 | A | 1/1998 | Wareheim | 108/186 |
| 5,752,610 | A | 5/1998 | Remmers | 211/181.1 |
| 6,079,339 | A | 6/2000 | Houk, Jr. et al. | 108/186 |
| 6,178,896 | B1 | 1/2001 | Houk, Jr. et al. | 108/186 |

*Primary Examiner*—Robert W. Gibson, Jr.
(74) *Attorney, Agent, or Firm*—Marshall, Gerstein & Borun LLP

(57) ABSTRACT

A shelving system includes a panel having a plurality of support structures, and one or more posts configured to support the panel. One type of support structure includes a pair of opposing beam members having an upper end, a lower end, and an intermediate wall coupling the upper and lower ends Upper and lower ends of opposing beam members define a plurality of orifices, and a terminal end of the upper end includes a downward projection configured to provide strength and rigidity. Another type of support structure includes a set of alternating opposed cavities defined by a pair of side walls, an upper wall, and a lower wall, where a first cavity is defined by the side walls and the upper wall and a second cavity adjacent the first wall is defined by the side walls and the lower wall.

19 Claims, 12 Drawing Sheets

BEAM STRUCTURES FOR SHELVING APPARATUS

CROSS-REFERENCE TO RELATED APPLICATIONS

The present invention claims priority under 35 U.S.C. § 119 from U.S. Provisional Patent Application No. 60/261,329 titled "BEAM STRUCTURES FOR SHELVING ASSEMBLIES" filed Jan. 12, 2001, the full disclosure of which is hereby incorporated by reference.

FIELD OF THE INVENTION

The present invention relates to beam structures for shelving systems or the like. More particularly, the present invention relates to beam structures that provide improved strength and rigidity.

BACKGROUND OF THE INVENTION

It is generally known to provide for a shelving system made of plastic, metal, wood, or combinations thereof. Such shelving systems typically include a plurality of panels connected and supported by a plurality of posts. Also, such shelving systems are intended to support the weight of one or more objects placed on the panel. It is also known to provide plastic panels with uniform wall thicknesses.

However, such panels have several disadvantages including a flexural modulus that allows the panel to bow, bend, or flex when weight is maintained over a period of time. Also, the amount of material and the types of material necessary to support anticipated loads may be costly (e.g., high flex modulus materials).

To provide an inexpensive, reliable, and widely adaptable beam structure that avoids the above-referenced and other problems would represent a significant advance in the art.

SUMMARY OF THE INVENTION

A primary feature of the present invention is to provide an inexpensive, easy-to-manufacture and aesthetically-pleasing shelving system that overcomes the above-noted disadvantages.

Another feature of the present invention is to provide a shelving system with an improved beam structure or a combination of beam structures.

Another feature of the present invention is to provide a shelving system with a beam structure having an increased strength-to-weight ratio and reduces load deflection at minimal part weight increases.

How these and other advantages and features of the present invention are accomplished (individually, collectively, or in various subcombinations) will be described in the following detailed description of the preferred and other exemplary embodiments, taken in conjunction with the FIGURES. Generally, however, they are accomplished in a support structure for a shelving system that includes a pair of opposing beam members having an upper end, a lower end, and an intermediate wall coupling the upper and lower ends. Upper and lower ends of opposing beam members define a plurality of orifices. A terminal end of the upper end includes a downward projection configured to provide strength and rigidity.

These and other features of the invention may also be accomplished in a support structure including a set of first beam structures, each having a pair of side walls, an upper wall, and a lower wall defining alternating oppositely disposed cavities, and a set of second beam structures, each having opposing beam members having an upper end, a lower end, and an intermediate wall coupling upper and lower ends. The first and second beam structures are combined to provide particular strength and rigidity characteristics.

The present invention further relates to various features and combinations of features shown and described in the disclosed embodiments. Other ways in which the objects and features of the disclosed embodiments are accomplished will be described in the following specification or will become apparent to those skilled in the art after they have read this specification. Such other ways are deemed to fall within the scope of the disclosed embodiments if they fall within the scope of the claims which follow.

DETAILED DESCRIPTION OF PREFERRED AND OTHER EXEMPLARY EMBODIMENTS

Before proceeding to the detailed description of the preferred and exemplary embodiments, several comments can be made about the general applicability and the scope thereof.

First, while the components of the disclosed embodiments will be illustrated as a shelving apparatus designed for a variety of items over short and/or long periods of time, the features of the disclosed embodiments have a much wider applicability. For example, the beam structure design is adaptable for other storage units, bins, containers, and other office, home, or educational products which employ a storage space configured to support items relative to one or more force concentration areas. Further, the size of the various components and the modularity of the shelving system is only preferred and can be widely varied.

Second, the particular materials used to construct the exemplary embodiments are also illustrative. For example, injection molded mineral-reinforced polypropylene is the preferred method and material for making the top and base, but other materials can be used, including other thermoplastic resins such as polypropylene, high density polyethylene, other polyethylenes, acrylonitrile butadiene styrene ("ABS"), polyurethane, nylon, any of a variety of homopolymer plastics, copolymer plastics, structural foam plastics with special additives, filled plastics, etc. Also, other molding operations may be used to form these components, such as blow molding, rotational molding, gas-assist injection molding, etc. The mold tooling preferably includes a projection (e.g., steel) on both the cavity and core to provide the desired design in either beam configuration.

Figure 1:
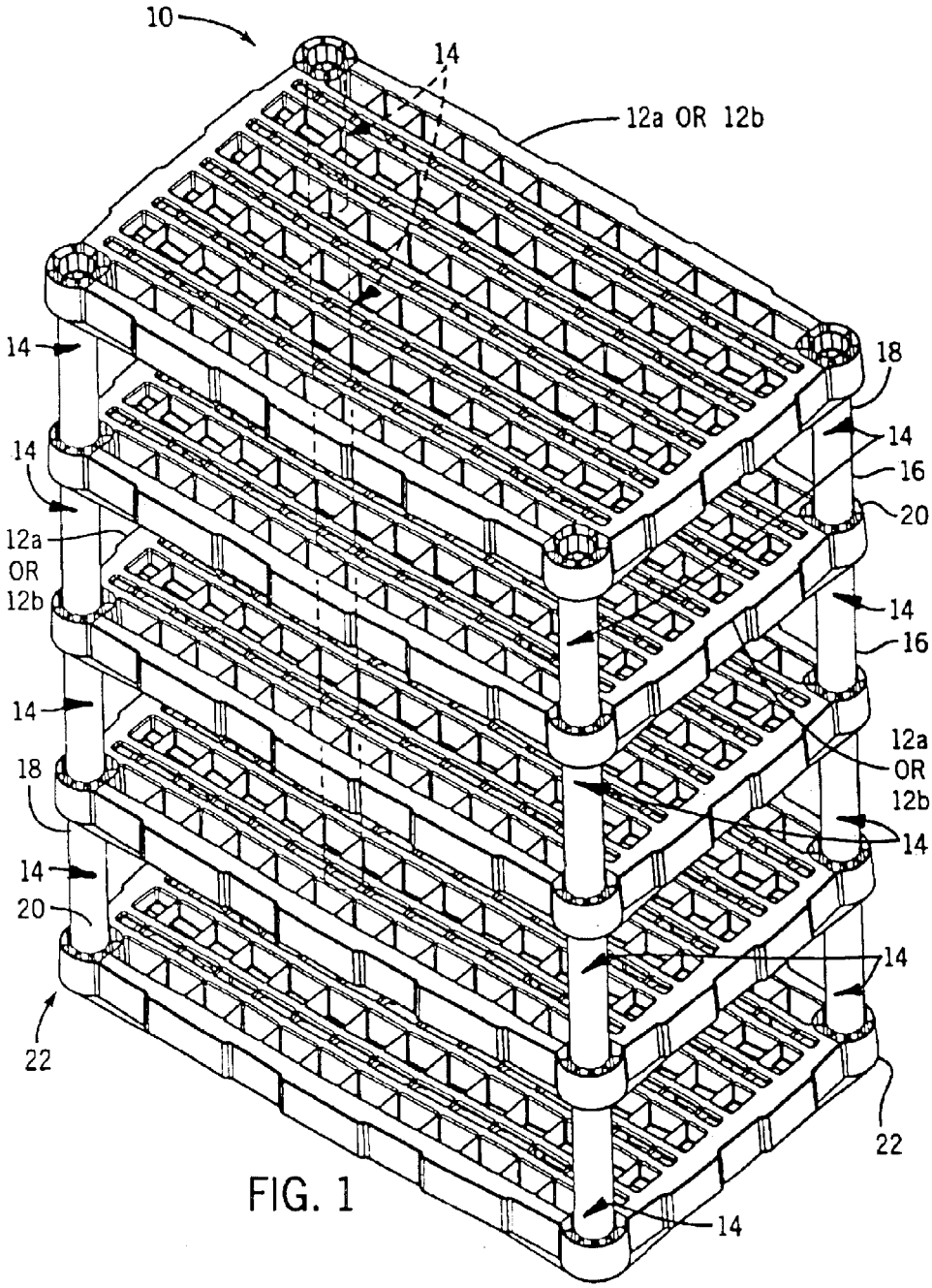
FIG. 1 is a perspective view of a shelving unit according to a preferred embodiment.
Figure 2:
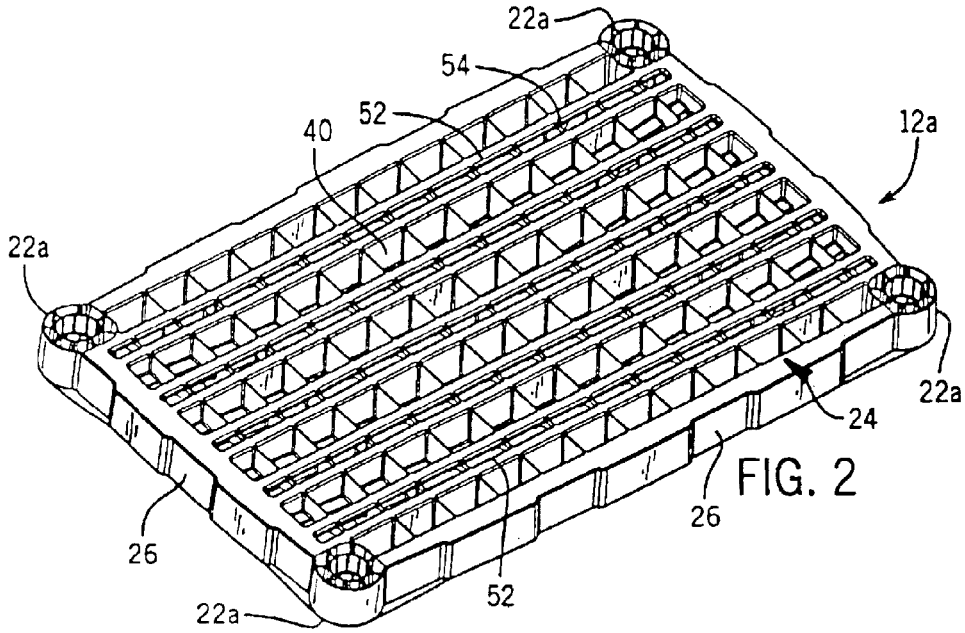
FIG. 2 is a top perspective view of a panel for the shelving unit of FIG. 1.

Proceeding now to descriptions of the preferred and exemplary embodiments, FIG. 1 shows a shelving system 10 according to a preferred embodiment. Shelving system 10 includes one or more panels (panel 12*a* in FIGS. 2–18 and panel 12*b* in FIGS. 19–25) supported by a plurality of posts 14. Each post 14 includes a shaft 16, a top portion 18, and a bottom portion 20. Top portion 18 and/or bottom portion 20 of posts 14 are configured to couple with sockets 22*a* of panel 12*a* or 12*b*. Posts 14 and sockets 22*a* are further disclosed in U.S. Pat. No. 6,079,339 which is incorporated herein by reference.

Panel 12*a* or 12*b* includes a support surface 24, a skirt 26 that extends generally downward around the perimeter of support surface 24, plurality of sockets 22*a* disposed generally at the corners of panel 12*a* or 12*b*, and a plurality of support structures (shown as rails or beams 28 in FIGS. 2–18, and rails or beams 30 in FIGS. 19–25). According to a preferred embodiment, the beams are spaced evenly across the width of panel 12*a* and span substantially the entire length of the panel. According to alternative embodiments, beams 28 or 30 may be concentrated in regions of increased stress loads and include one or more beams. Beams 28 terminate at a wall 32 that connects a pair of sockets 22*a*. Beams 30 terminate at skirt 26 or sockets 22*b*.

Panels 12*a* also include a plurality of ribs 34 connect beams 28 or 30 with a lower side 36 of support surface 24. According to a preferred embodiment, ribs 34 are generally perpendicular to beams 28 or 30 and have varying dimensional characteristics. Also, ribs 34 may have any of a variety of dimensional characteristics (e.g., width, thicknesses, heights, etc.). According to an alternative embodiment, ribs 34 may be parallel to beams 28 or 30.

Referring to FIGS. 2–18, each beam 28 includes a pair of opposing beam members (shown as "Z"-shaped members 38, wherein "Z-shaped" refers to the cross-sectional appearance of adjacent halves of the beam). Each Z-shaped member 38 includes an intermediate wall 40 and a pair of ends (shown as an upper end 42 and a lower end 44). Upper end 42 and lower end 44 provide structure for adjacent beams 28. An upper side 46 of upper end 42, at least partially, comprises support surface 24. According to a preferred embodiment, intermediate wall 40 is generally vertical and approximately perpendicular to support surface 24. According to alternative embodiments, intermediate wall 40 is generally not perpendicular to support surface 24 and may be configured to have any of a variety of angles relative to support surface 24.

A plurality of apertures 48 are defined by opposed lower ends 44 and a lower rib 50. A plurality of apertures 52 in support surface 24 are defined by opposed upper ends 42 and an upper rib 54. A "small return" (shown as a projection 56) extends generally downward about apertures 52. Projection 56 is intended to provide additional rigidity to support surface 24 and provide a smoother support surface 24 without additional finishing operations after panel 12*a* is molded. According to alternative embodiments, projection 56 has any of a variety of heights which may be configured to support the intended or anticipated load.

Figure 11:
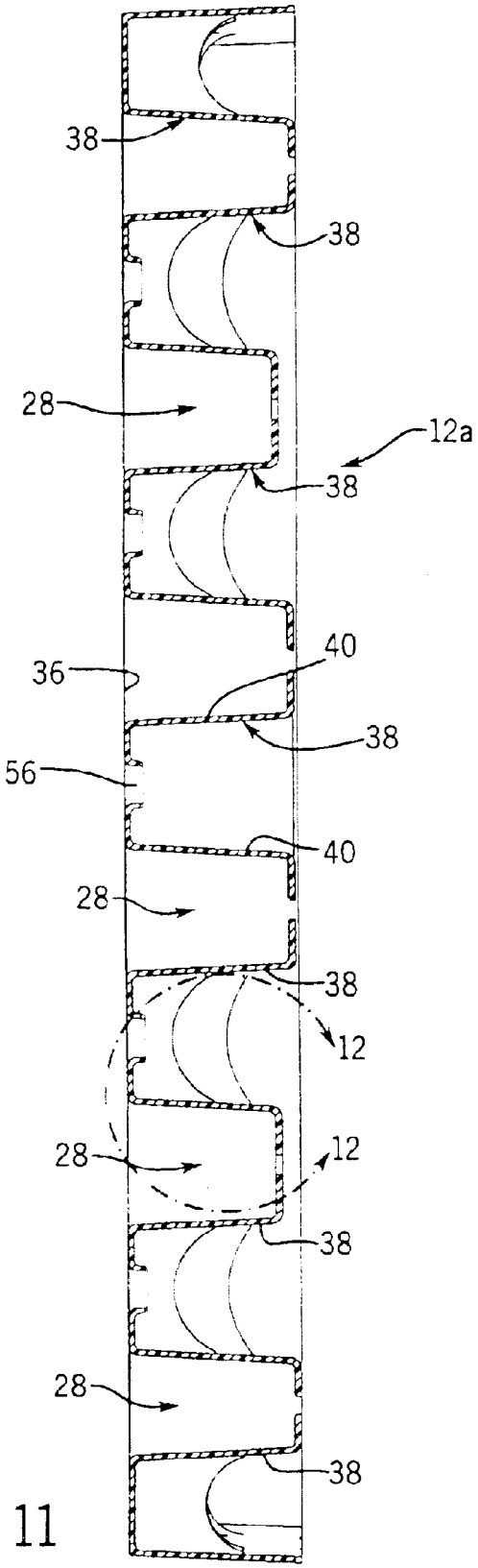
FIG. 11 is a sectional view of the panel of FIG. 4 taken along the line 11—11.
Figure 12:
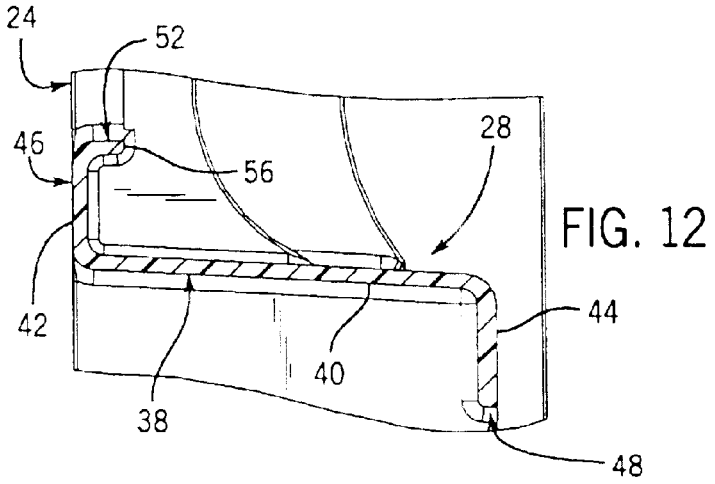
FIG. 12 is a fragmentary sectional view of the panel of FIG. 11.

As shown in the cross sectional view in FIG. 11, adjacent "Z"-shaped members 38 alternate directions across the width of panel 12*a* and form a continuous support along the length of panel 12*a*. The particular dimensional characteristics of "Z"-shaped members 38, are intended to provide increased strength and flexural resistance.

According to an exemplary embodiment, upper ends 42 and lower ends 44 have an increased amount of material than in known "Z"-shaped supports. Such a configuration provides increased manufacturing efficiencies and strength-to-weight ratios. According to a preferred embodiment, upper ends 42 and lower ends 44 have a greater amount of wall thickness than intermediate wall 40, and extend further from intermediate wall 40 than in known "Z"-shaped supports. According to a particularly preferred embodiment, upper ends 42 and lower ends 44 have about 50% larger wall thickness than intermediate wall 40, and extend out from intermediate wall 40 by approximately 100% (i.e., approximately twice as far). According to alternative embodiments, the additional distance which upper ends 42 and lower ends 44 project from intermediate wall 40 may be determined by the desired performance characteristics (e.g., between about 20% and about 200%). By increasing strength and flexural resistance, panel 12*a* requires a reduced number of beams per square inch or square feet of surface area. Reducing the number of beams is intended to reduce the overall panel weight thereby reducing manufacturing and shipping costs. Also, adopting one or more of these design embodiments, the height of the intermediate wall need not be increased for additional strength.

Figure 8:
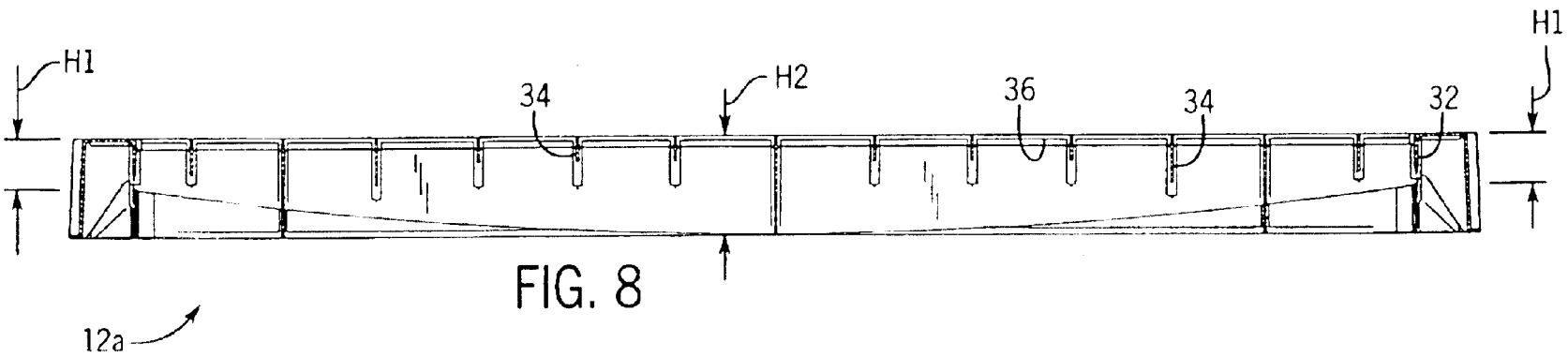
FIG. 8 is a sectional view of the panel of FIG. 4 taken along the line 8—8.
Figure 9:
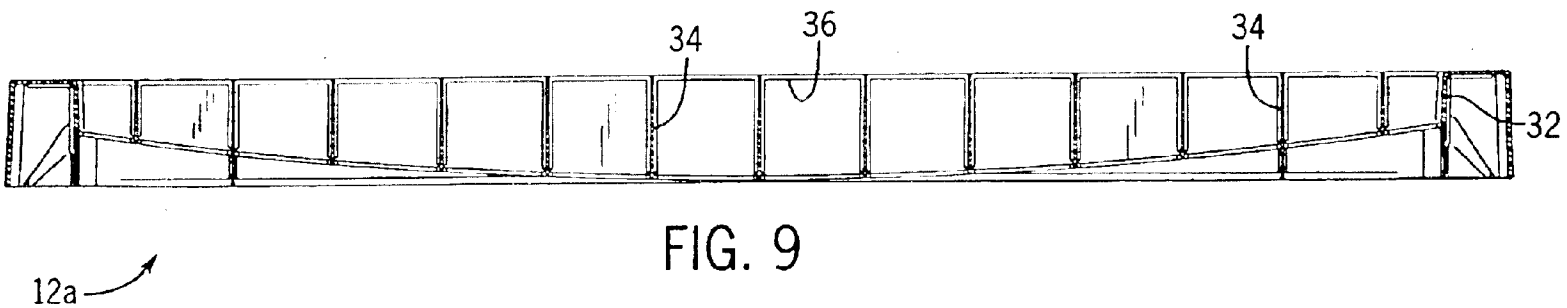
FIG. 9 is a sectional view of the panel of FIG. 4 taken along the line 9—9.

As shown in FIG. 8, ends 42, 44 of some "Z"-shaped members 38 provide a first height H1 which is less than the height of intermediate portion 40. According to a preferred embodiment, "Z"-shaped members 38 have a curvilinear parabolic shape with a vertex approximately in the middle of "Z"-shaped members 38. According to a particularly preferred embodiment, "Z"-shaped members 38 nearest skirt 26 have a continuous height, and inner "Z"-shaped members 38 have the curved configuration (e.g., to save on material and ship weight).

Figure 3:
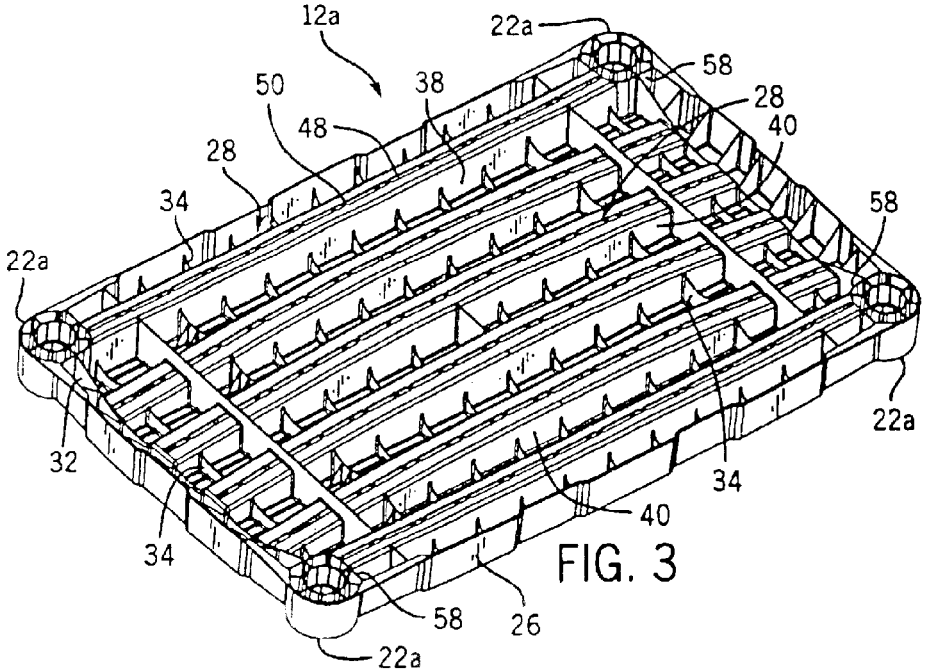
FIG. 3 is a bottom perspective view of the panel of FIG. 2.
Figure 4:
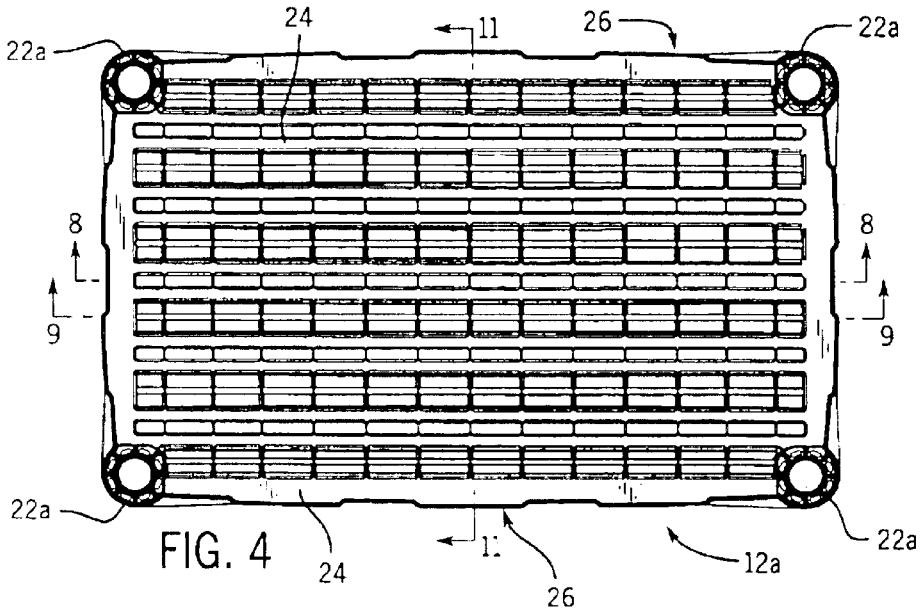
FIG. 4 is a top plan view of the panel of FIG. 2.
Figure 5:
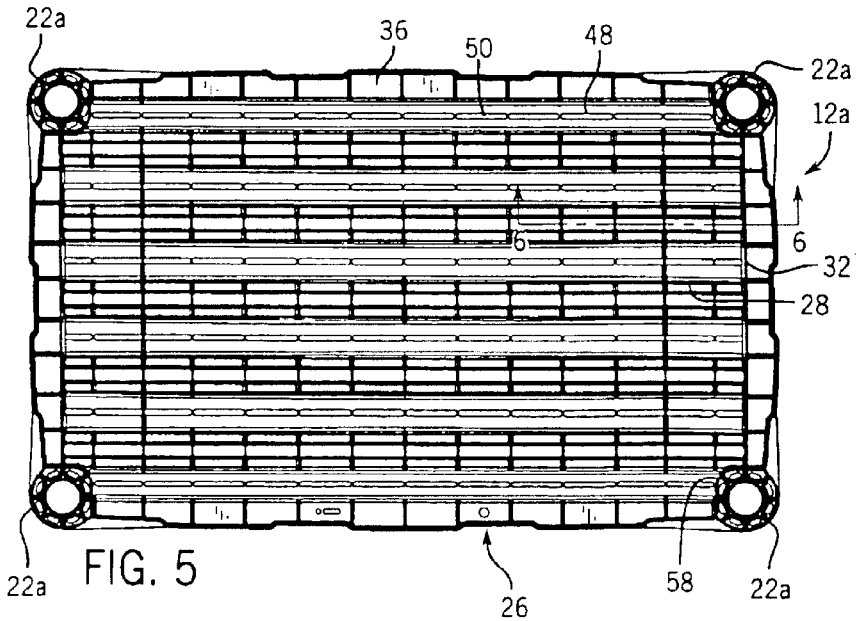
FIG. 5 is a bottom plan view of the panel of FIG. 2.
Figure 6:
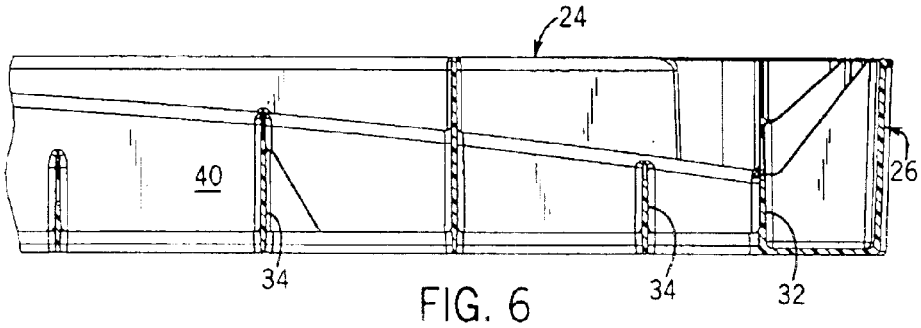
FIG. 6 is a fragmentary sectional view of the panel of FIG. 5 taken along the line 6—6.
Figure 7:
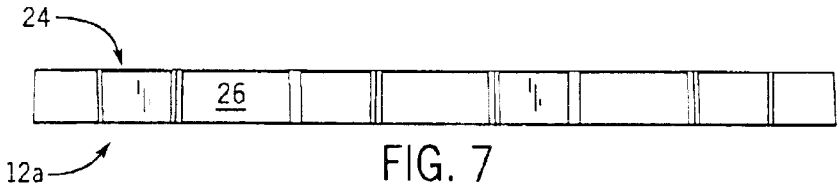
FIG. 7 is a side elevation view of the panel of FIG. 2.
Figure 10:
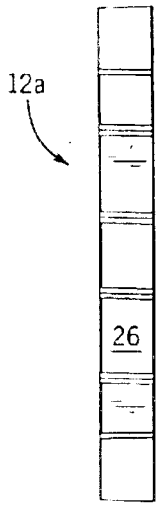
FIG. 10 is a side elevation view of the panel of FIG. 2.
Figure 13:
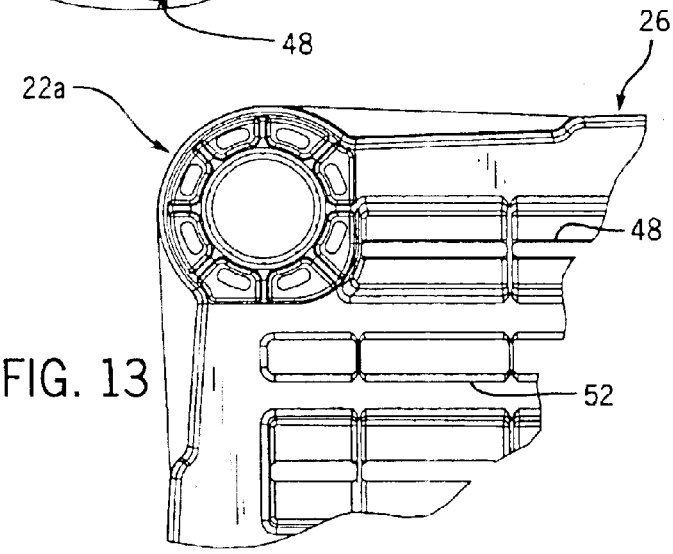
FIG. 13 is a fragmentary top plan of a socket for the panel of FIG. 2.
Figure 14:
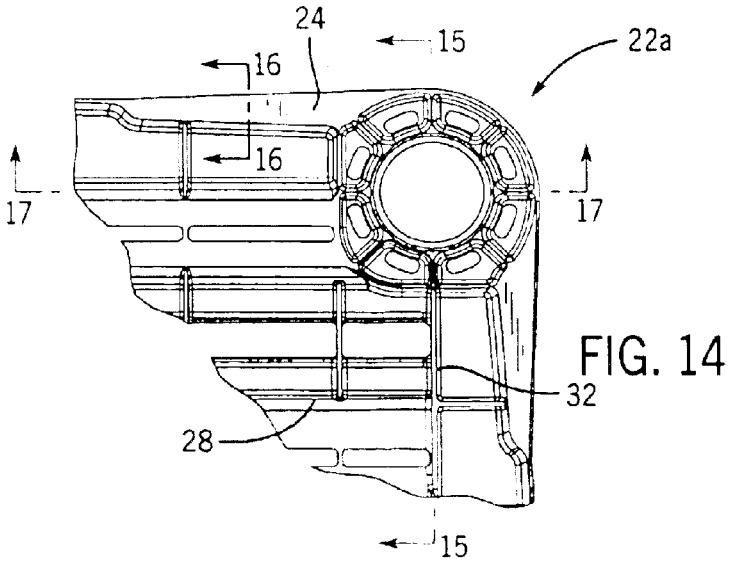
FIG. 14 is a fragmentary bottom plan view schematic block flow diagram of the socket of FIG. 13.
Figure 15:
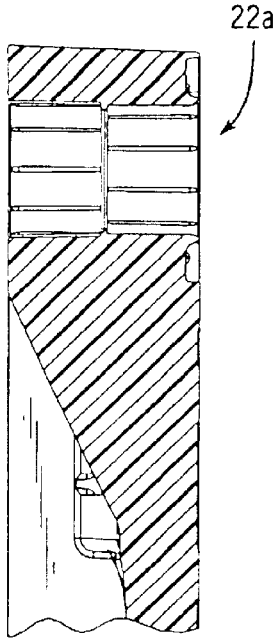
FIG. 15 is a fragmentary sectional view of the socket of FIG. 14 taken along the line 15—15.
Figure 16:
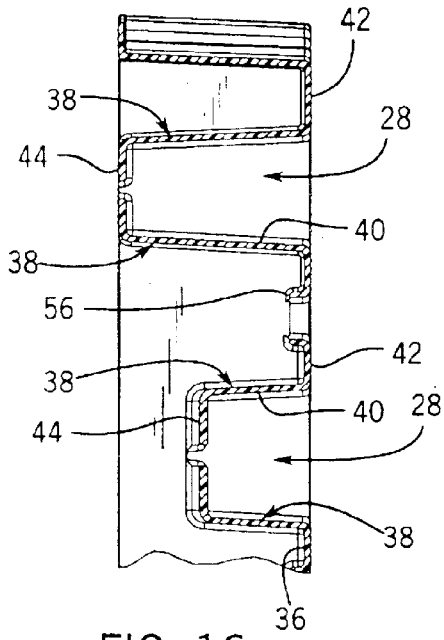
FIG. 16 is a fragmentary sectional view of the socket of FIG. 14 taken along line 16—16.
Figure 17:
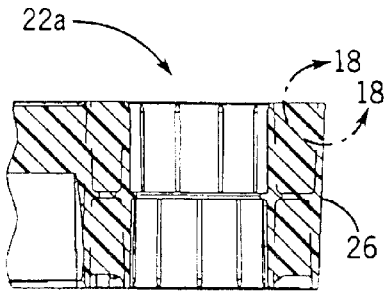
FIG. 17 is a fragmentary sectional view of the socket of FIG. 14 taken long the line 17—17.
Figure 18:
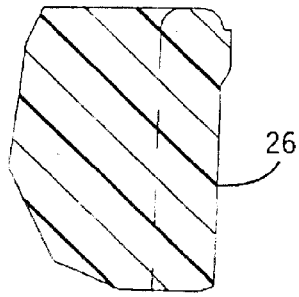
FIG. 18 is a fragmentary sectional view of the socket of FIG. 17.
Figure 19:
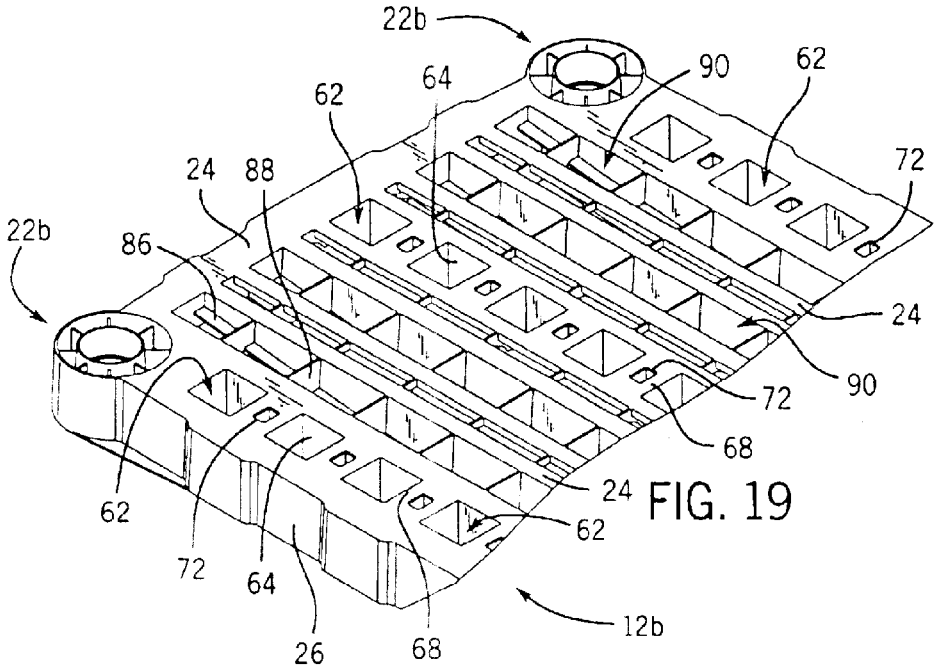
FIG. 19 is a top perspective view of a panel for a shelving unit according to an exemplary embodiment.
Figure 20:
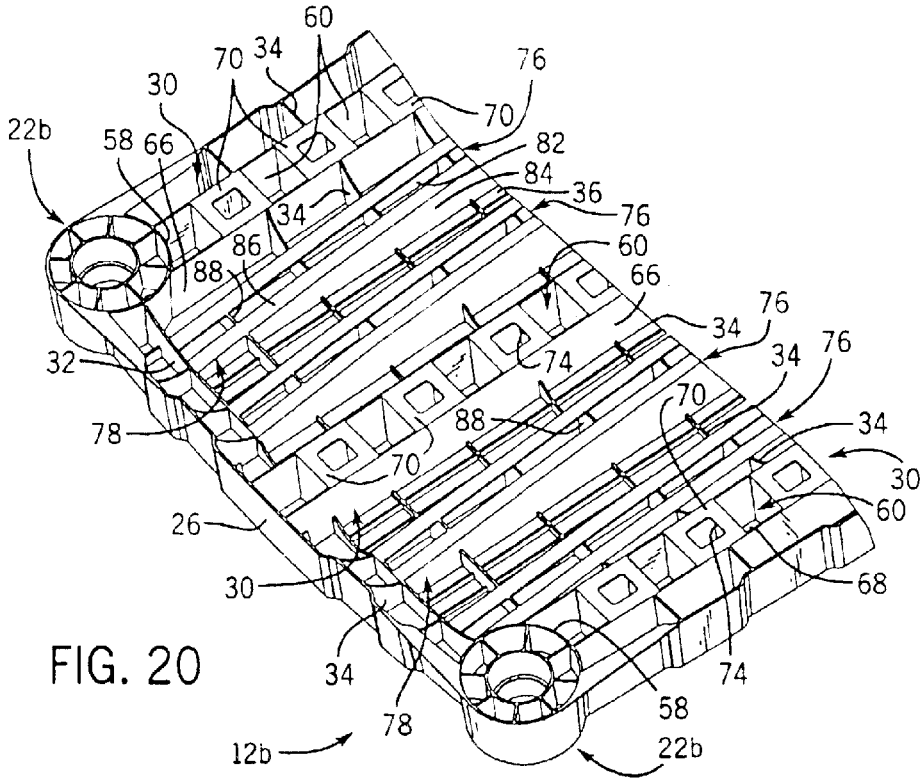
FIG. 20 is a bottom perspective view of the panel of FIG. 19.
Figure 21:
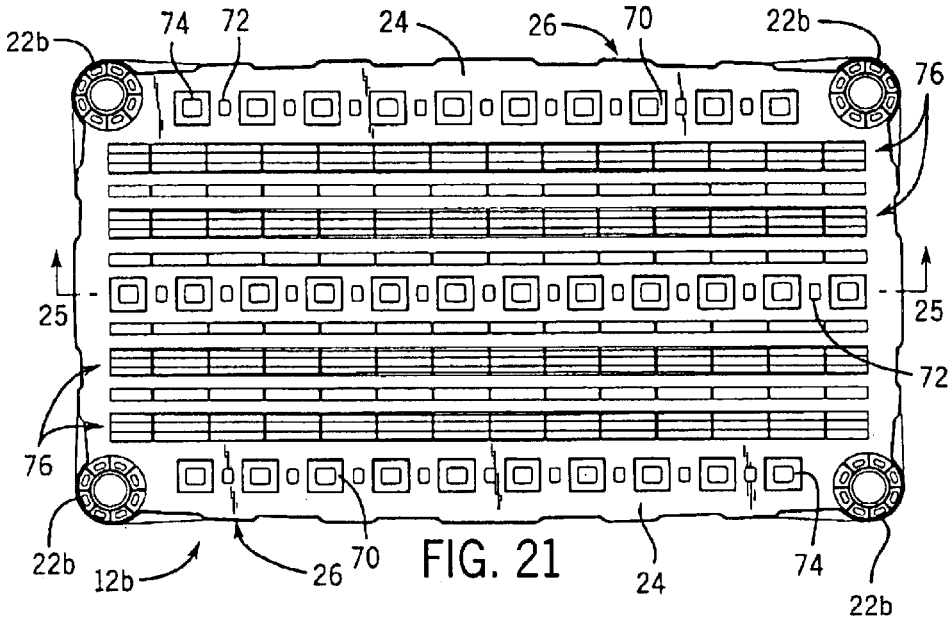
FIG. 21 is a fragmentary top plan view of the panel of FIG. 19.
Figure 22:
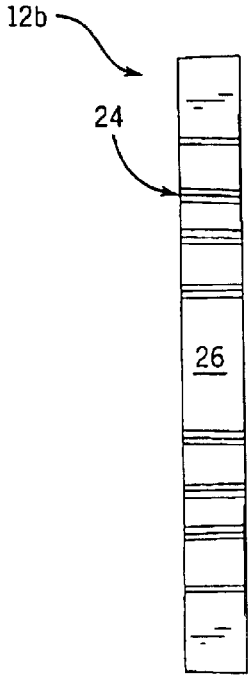
FIG. 22 is a side elevation view of the panel of FIG. 21.
Figure 23:
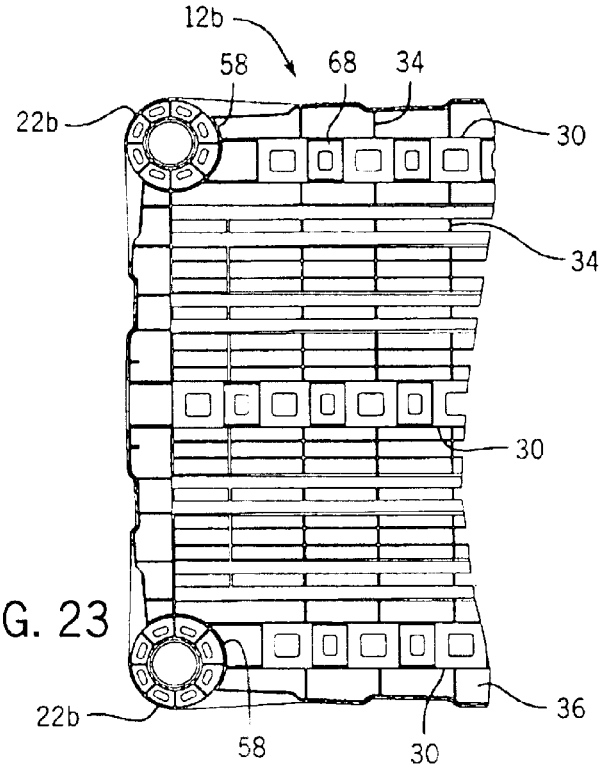
FIG. 23 is a fragmentary bottom plan view of the panel of FIG. 21.
Figure 24:
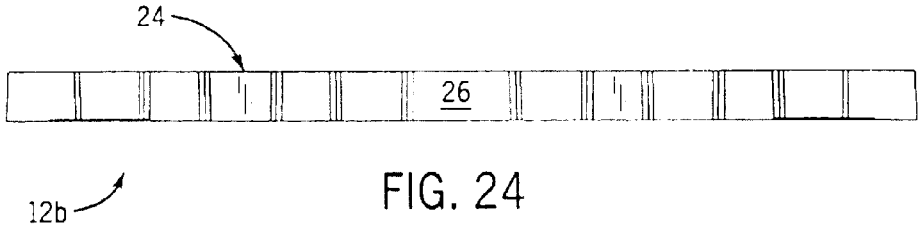
FIG. 24 is a front elevation view of the panel of FIG. 21.
Figure 25:
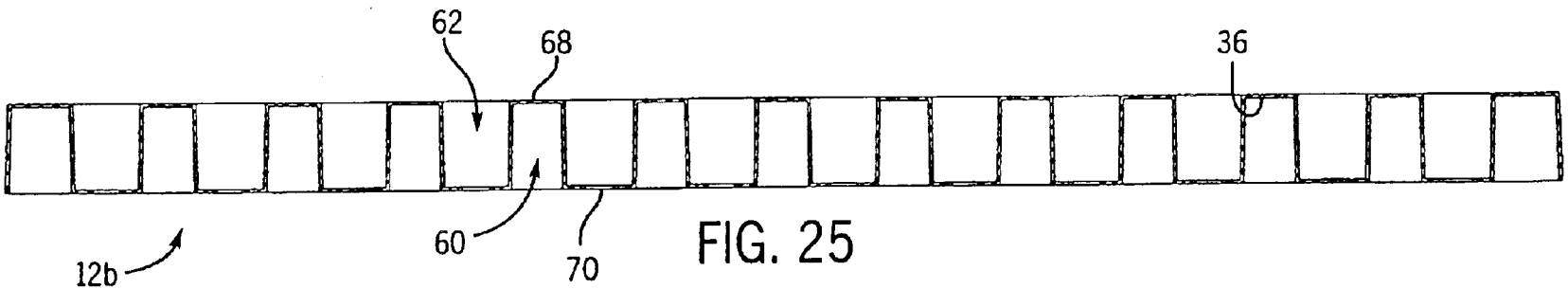
FIG. 25 is a sectional view of the panel of FIG. 21 taken along the line 25—25.

As shown in FIGS. 3, 13, and 14, intermediate walls 40 and wall 32 are configured to terminate at socket 22*a* for a stronger integration and connection with sockets 22*a*. As shown, outer wall 58 of socket 22*a* is generally planar (e.g., flattened out) so that wall 32 may continue towards skirt 26. Generally, planar outer wall 58 at sockets 22*a* is intended to provide additional strength, strength characteristics that are more predictable, require simpler tooling for molds.

According to an exemplary embodiment, panel 12*a* is approximately 38 inches by 24 inches. (Alternatively, the panel is approximately 42 inches by 24 inches, or have any of a variety of dimensions according to desired storage needs.) According to an exemplary embodiment, upper end 42 is between about 0.500 inches and about 1.000 inches. According to a preferred embodiment, upper end 42 is approximately 0.750 inches. According to a particularly preferred embodiment, upper end 42 is approximately 0.719 inches. According to alternative embodiments, the upper end may be any of a variety of dimensions depending on the configuration and size of the shelf system.

According to an exemplary embodiment, lower end 44 is between 0.500 inches and 1.000 inches. According to a preferred embodiment, lower end 44 is approximately 0.750 inches. According to a particularly preferred embodiment, lower end 44 is approximately 0.751 inches. According to alternative embodiments, the lower end may be any of a variety of dimensions depending on the configuration and size of the shelf system.

Referring to FIGS. 19–25, panel 12*b* is shown with sockets 22*b* and "box" beams 30 according to an alternative embodiment. "Box" beams 30 include a set of alternating opposed cavities 60, 62 defined by side walls 64, 66, an upper wall 68, and a lower wall 70. Upper wall 68 includes an aperture 72. Lower wall 70 includes an aperture 74. According to a preferred embodiment, aperture 74 is larger than aperture 72 to maximize support surface 74 and minimize weight and material without reducing flexural strength.

As shown, three beams 30 are disposed across the width of panel 12*b*. According to alternative embodiments, any number of beams may be employed in panel 12*b* according to desired strength characteristics. Also as shown, beams 30 have a constant height across the length of panel 12*b*. According to alternative embodiments, height may vary (e.g., have a reduced height near skirt 26) and an increased height near the middle of panel 12*b* (e.g., to affect deflection characteristics or to minimize material).

According to a preferred embodiment, a pair of "Z"-shaped beams 76 are disposed between "box" beams 30. "Z"-shaped beams 76 are shown to span ends of panel 12*b*. According to a preferred embodiment, ends 78 of "Z"-shaped beams 76 have a first height HH1 which is less than a second height HH2 at intermediate portion 80. "Z"-shaped beams 76 have a curvilinear parabolic shape with a vertex approximately in the middle of "Z"-shaped beams 76.

"Z"-shaped beams 76 include a pair of intermediate side walls 82, 84, a bottom wall 86, and a rib 88 perpendicular to side walls 82, 84. A plurality of cavities 90 are defined by side walls 82, 84, bottom walls 86, and rib 88. According to a preferred embodiment, a plurality of ribs 34 are disposed between beams 30 and "Z"-shaped beams 76, and are perpendicular to side walls 64, 66 of beams 30 and side walls 82, 84 of "Z"-shaped beams 76. Alternatively, ribs 34 extend from lower side 36 of support surface 24 so as to increase rigidity. Ribs 34 are disposed generally parallel with both beams 30 and "Z"-shaped beams 76 and have any of a variety of heights.

It is also important to note that the construction and arrangement of the elements of the beam structures as shown in the preferred and other exemplary embodiments are illustrative only. Although only a few embodiments of the present invention have been described in detail in this disclosure, those skilled in the art who review this disclosure will readily appreciate that many modifications are possible (e.g., variations in sizes, dimensions, structures, shapes and proportions of the various elements, values of parameters, mounting arrangements, materials, colors, orientations, etc.) without materially departing from the novel teachings and advantages of the subject matter recited in the claims. For example, such beam structures may be applied to pallets, stepstools, or any plastic surface that requires high strength at optimized part weights. Accordingly, all such modifications are intended to be included within the scope of the present invention as defined in the appended claims. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and/or omissions may be made in the design, operating conditions and arrangement of the preferred and other exemplary embodiments without departing from the spirit of the present invention as expressed in the appended claims.

What is claimed is:

1. A shelving system comprising:

a panel having a plurality of support structures;

at least one post configured to support the panel;

each support structure including a pair of opposing beam members having an upper end, a lower end, and an intermediate wall coupling the upper and lower ends, the upper ends defining a support surface of the panel;

wherein said upper and lower ends of opposing beam members define a plurality of orifices, and a terminal end of the upper end includes a downward projection configured to provide strength and rigidity to the panel; and wherein the plurality of support structures include at least one inner support structure having a curved configuration resulting in a non-continuous height over the length of the panel and at least one outer support structure having a continuous height over the length of the panel.

2. The shelving system of claim 1 wherein the intermediate wall is generally vertical and approximately perpendicular to the support surface.

3. The shelving system of claim 1 wherein the intermediate wall is generally angled relative to the support surface.

4. The shelving system of claim 1 wherein the projection is configured to provide a smoother surface without additional finishing operations after panel is molded.

5. The shelving system of claim 1 wherein the beam members from adjacent support structures form alternating "Z"-shaped members across the width of the support structure and form a continuous support along the length of the support structure.

6. The shelving system of claim 1 wherein the upper cads and lower ends have an increased amount of material compared to the intermediate wall.

7. The shelving system of claim 6 wherein the upper ends and lower ends have about 50% larger wall thickness than the intermediate wall, and extend out from the intermediate wall by approximately two times the intermediate wall thickness.

8. The shelving system of claim 1 wherein a height of the intermediate wall of the inner support structure varies over the length of the panel.

9. A shelving system comprising:

a panel including a plurality of support structures;

a plurality of posts configured to support the panel;

at least one support structure having a height and including a set of alternating opposed cavities defined by a pair of side walls, an upper wall, and a lower wall;

wherein a first cavity is defined by the side walls and the upper wall, and a second cavity adjacent the first cavity is defined by the side walls and the lower wall; and wherein the upper wall includes a first aperture, the lower wall includes a second aperture, and wherein said second aperture is larger than said first aperture to maximize the support surface and minimize weight and material without reducing flexural strength.

10. The shelving system of claim 9 wherein the panel includes three support structures disposed across the width of the panel.

11. The shelving system of claim 9 wherein the support structures have constant height over the length of the panel.

12. The shelving system of claim 9 wherein the support structure height varies over the length of the panel such that the support structure height is reduced near an outer portion of the support structure and increased near an inner portion of the support structure.

13. A shelving system comprising:

at least one panel;

a plurality of posts configured to engage sockets in the panels to support the at least one panel;

wherein each panel includes:

a set of first support structures including a pair of side walls, an upper wall, and a lower wall defining alternating oppositely disposed cavitics, wherein a first cavity is defined by the side walls and the upper wall, and a second cavity adjacent the first cavity is defined by the side walls and the lower wall;

a set of second support structures including opposing beam members having an upper end, a lower end, and an intermediate wall coupling the upper and lower ends;

wherein the first and second support structures are combined to provide particular strength end rigidity characteristics; and wherein the set of first support structures are box beams and the set of second support structures are Z-shaped beams.

14. The shelving system of claim 13 wherein a height of the set of first support structures varies over the length of the panel.

15. The shelving system of claim 13 wherein the first and second support structures have a curvilinear parabolic shape with a vertex approximately in the middle of the support structures.

16. The shelving system of claim 13 wherein the support structures are spaced across the width of the panels, and the first set of support structure are located towards the outer portion of the panel and the second set of support structures are located toward the interior of the panel.

17. The shelving system of claim 13 wherein the upper wall includes a first aperture, the lower wall includes a second aperture, and the second aperture is larger than the first aperture.

18. The shelving system of claim 1 wherein the at least one outer support structure includes a set of alternating opposed cavities defined by a pair of side walls, an upper wall, and a lower wall, such that a first cavity is defined by the side walls and the upper wall, and a second cavity adjacent the first cavity is defined by the side walls and the lower wall.

19. The shelving system of claim 18 wherein the upper wall includes a first aperture, the lower wall includes a second aperture, and the second aperture is larger than the first aperture.

* * * * *

UNITED STATES PATENT AND TRADEMARK OFFICE

CERTIFICATE OF CORRECTION

PATENT NO. : 6,820,757 B2 
APPLICATION NO. : 10/017853
DATED : November 23, 2004
INVENTOR(S) : Craft et al.

It is certified that error appears in the above-identified patent and that said Letters Patent is hereby corrected as shown below:

Column 2, line 6, Abstract: "ends Upper" should be --ends. Upper.--.

Column 6, line 35, "include" should be -- includes --.

Column 6, line 48, "after panel" should be -- after the panel --.

Column 6, line 54, "cads" should be -- ends--.

Column 7, line 30, "cavitics," should be --cavities, --

Column 8, line 2, "end" should be -- and --.

Column 8, line 17, "structure" should be -- structures --.

Signed and Sealed this

Sixth Day of March, 2007

JON W. DUDAS
*Director of the United States Patent and Trademark Office*